US005272775A

United States Patent [19]

Walraven

[11] Patent Number: 5,272,775

[45] Date of Patent: Dec. 28, 1993

[54] PLUMBING FIXTURE

[76] Inventor: Hank Walraven, 2210 Wilshire Blvd., #689, Santa Monica, Calif. 90403-5784

[21] Appl. No.: 749,139

[22] Filed: Aug. 23, 1991

[51] Int. Cl.[5] ..... E03C 1/262; E03C 1/264

[52] U.S. Cl. ..... 4/652; 4/287; 4/651

[58] Field of Search ..... 4/651, 652, 286, 287, 4/288, 291, 292, 650, 654, 679, 680

[56] References Cited

U.S. PATENT DOCUMENTS 3,895,401 7/1975 Walraven ..... 4/651

FOREIGN PATENT DOCUMENTS 0754468 8/1956 United Kingdom ..... 4/292

*Primary Examiner*—William A. Cuchlinski, Jr.

*Assistant Examiner*—W. Morris Worth

[57] ABSTRACT

Disclosed is plumbing fixture integrated with the side of a sink and the like having an elongated compartment extending lengthwise along at least a portion of the height of the side wall or piece. The compartment has a bottom with a drain and an open side which allows liquid from a sink to flow into the compartment. A removable strainer is placed in position at the open side of the compartment, and a standpipe is placed in the drain. There is a catch connected to the strainer which is manually movable between a latched position to hold the strainer in position and an unlatched position which allows the strainer to be removed from the open side of the compartment. The standpipe may be removed when the catch is in the latched positioned, but may be locked so that it cannot be removed, yet may still be moved within limits to permit the drain to be opened.

9 Claims, 6 Drawing Sheets

PLUMBING FIXTURE

BACKGROUND OF THE INVENTION

1. Field of the Invention

This invention relates to a plumbing fixture for controlling the flow of liquid from a sink, bain marie, fryer tank, basin, bath tubs, swimming pools, etc. It prevents solid material in the liquid from flowing into the drainage system to which the sink and the like is in communication. The solid material, usually organic matter, may be collected and used for compost.

2. Background Discussion

In U.S. Pat. No. 3,895,401, there is disclosed a drain fixture which is located in the back wall of the sink. This fixture includes an open sided compartment running substantially along the entire height of the sink, having a drain at the bottom of the compartment. A standpipe is seated in the drain and can be moved upwardly, vertically to open the drain. A strainer is in the open, front side of the compartment, which prevents solid material from flowing into the compartment. A disadvantage of this drain fixture is that the strainer is elevated when the standpipe is lifted from the drain, allowing solid material to flow through the drain and into the drainage system. This solid material, usually organic food matter, places an excess burden on the capacity of the water treating facility to clean the waste water. In particular, in a septic tank, this excess solid material overloads the septic tank, requiring the use of larger leach fields and shortening the life of the septic tank.

SUMMARY OF THE INVENTION

It is the objective of this invention to provide an improved plumbing fixture which allows the standpipe to be raised and lowered while leaving a strainer element in position. The invention includes a catch-and-lock mechanism that can be released to allow the strainer element to be removed.

The plumbing fixture of this invention like the prior art fixture includes an elongated compartment. Preferably, the compartment extends vertically from the bottom of the sink to the top of the sink substantially along the entire height of the sink. It may, however, extend only partially along the height. The bottom wall or floor of the compartment has a passageway adapted to be placed in communication with the drainage system. An open side in the compartment facing the interior of the sink allows water from the sink to flow into the compartment, and a strainer element having a perforated face prevents solid material from flowing from the sink into the compartment. The strainer element is adapted to be positioned at the compartment's open side and to be removed from the open side periodically to clean it. A standpipe, moveable between a raised position for drainage and lower position where the bottom of the standpipe is inserted into the passageway, controls the flow of liquid through the passageway. The standpipe may also be removed for cleaning. It is important, however, to keep the strainer in position during use so that solid material does not flow into the drain and clog it. Because the plumbing fixture of this invention is located at the rear or side, the space beneath the sink may be used for storage since the drain is not in the way.

The first feature of this invention is a catch, which is manually moveable between a fastened position to hold the strainer element in position at the open side and an unfastened position which allows the strainer element to be removed. The catch prevents inadvertent removal of the strainer element and enables the standpipe to be raised or lowered independent of the strainer element.

The second feature is the use of a locking mechanism to prevent the standpipe from being manually withdrawn from the fixture, but allows the standpipe to be moved within limits between raised and lowered positions, yet not be completely withdrawn from the compartment.

The third feature is the use of a filter overlying the face of the strainer element, upstream of the drain, which is adapted to purify liquid hydrocarbons which may be present in the liquid flowing into the compartment. Preferably, there are means in communication with the filter for recycling the purified hydrocarbons. This recycling means may be a passageway in communication with the compartment which directs the purified hydrocarbons to a collection basin.

The fourth feature is that the catch comprises a stop which extends outwardly from a sidewall in the compartment, a guide member connected to the strainer element and extending into the compartment, and a latch which is manually moveable between the fastened position where the latch engages the stop and an unfastened position where the latch disengages from the stop. There is an opening in the latch that allows the standpipe to pass through it when the latch is in the fastened position, but prevents the standpipe from being inserted through the latch when in the unfastened positioned.

The fifth feature is that the strainer element has a ledge which extends into the compartment when the strainer element is at the open side of the compartment, and the standpipe has a stop near its upper end that is adapted to rest on the ledge by lifting and rotating the standpipe so the stop overlies the ledge. There are means on the catch which prevent the stop element on the standpipe from being positioned beneath the ledge.

The sixth feature is that the compartment includes alignment pins and the strainer element includes means which, in conjunction with the alignment pins, guide the strainer element into position at the open side of the compartment and hold the strainer element in this position.

The drain fixture of this invention has these and other features, but no single feature is solely responsible for its desirable attributes. Without limiting the scope of this invention as expressed by the claims which follow, the features of this invention will now be illustrated by the preferred embodiment of this invention disclosed herein. After considering the following section entitled, "DETAILED DESCRIPTION OF THE PREFERRED EMBODIMENT," one will understand how the features of this invention provide its attributes, which include improved removal of solids from waste liquids, an environmentally enhanced drainage system, simplicity of construction and use, greater undersink storage capacity, and, most importantly, the elimination of clogging of the drain.

BRIEF DESCRIPTION OF THE DRAWING

The preferred embodiment of this invention, illustrating all its features, will now be discussed in detail. This embodiment depicts the novel and non-obvious drain fixture of this invention shown in the accompanying drawing, which is for illustrative purposes only. This drawing includes the following figures (FIG.), with like numerals indicating like parts.

DESCRIPTION OF THE PREFERRED EMBODIMENTS

Figure 1:
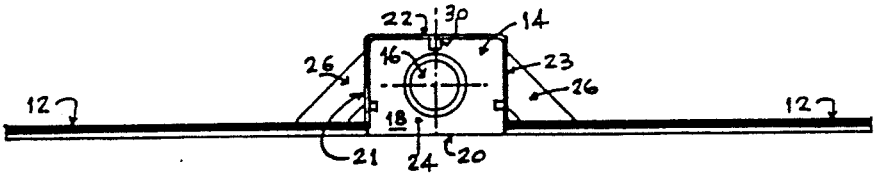
FIG. 1 is a plan view of a back piece in which the drain fixture of this invention is to be installed.
Figure 2:
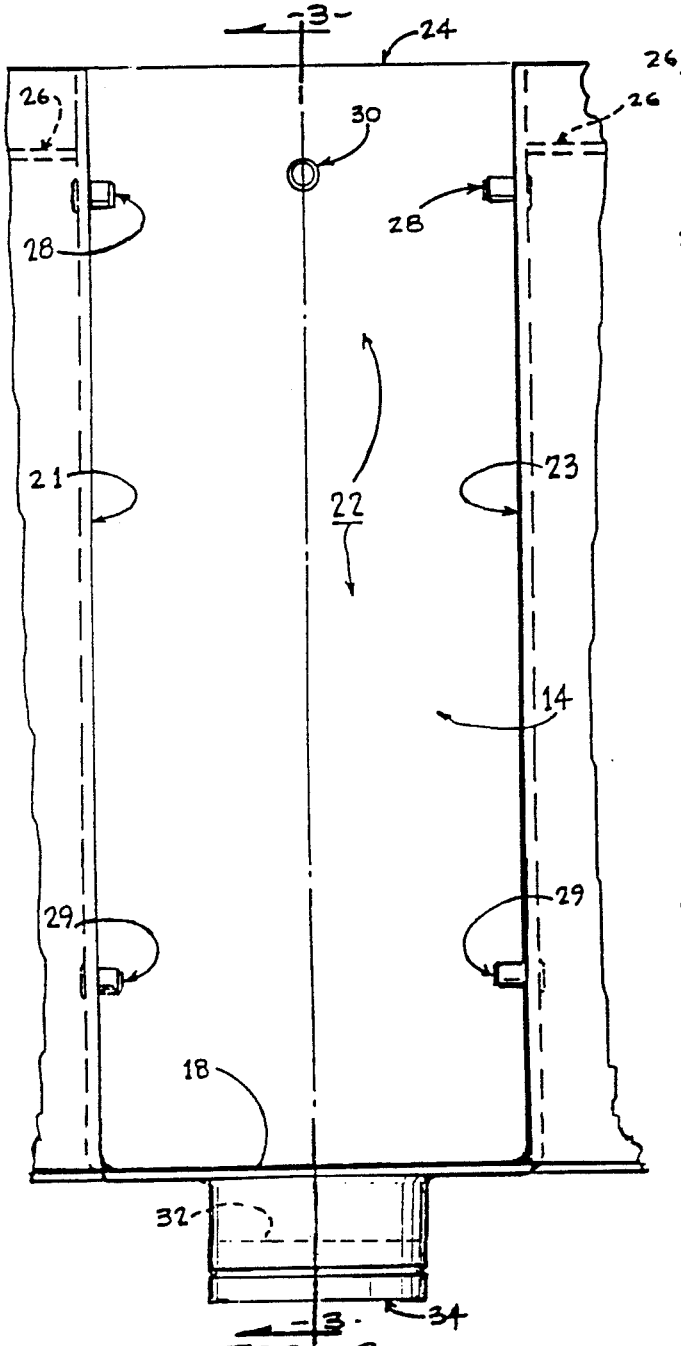
FIG.2 is a front elevational view of the compartment in the back piece shown in FIG. 1.
Figure 3:
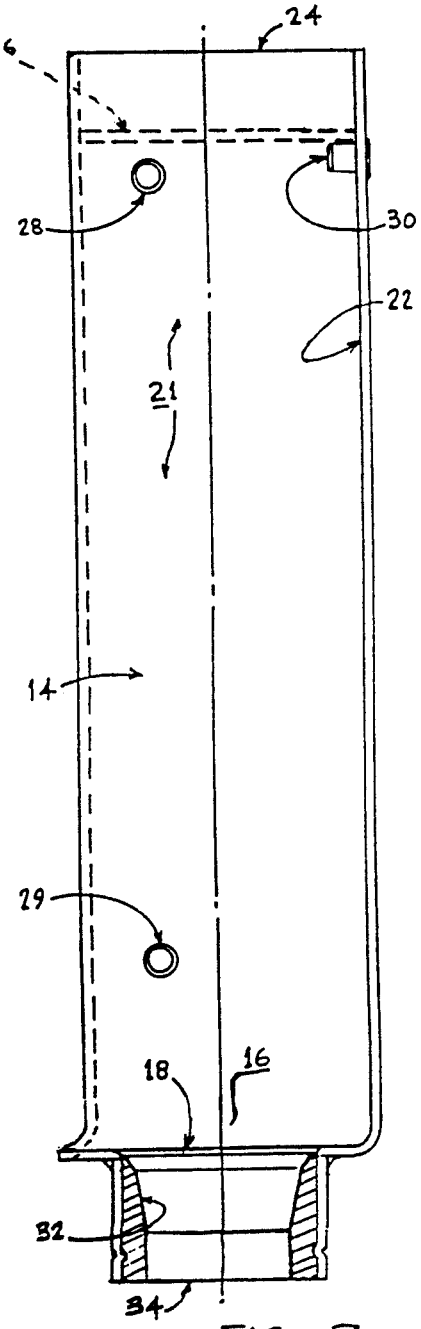
FIG. 3 is a cross-sectional view taken along line 3—3 of FIG. 2.
Figure 11:
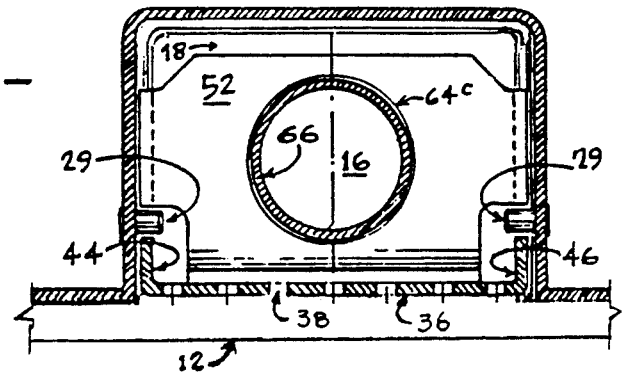
FIG. 11 is a cross-sectional view taken along line 11—11 of FIG. 6, with the standpipe removed.

The plumbing fixture 10 of this invention includes a backside piece 12 as best shown in FIGS. 1, 5, 6 and 18. The backside piece 12 may be a separate component which is subsequently assembled with other components to form the rear wall of a conventional sink, bain marie, fryer tank, basin, bath tub, swimming pool, etc. The backside piece 12 has an elongated compartment 14 that extends along a substantial portion of the height of the back piece. A drain 16 for the sink and the like is located in the bottom wall 18 of the compartment 14 (as illustrated in FIGS. 1 and 11), rather than in the central portion of the bottom wall (not shown) of the sink. The bottom wall of the sink slops towards the compartment 14. The compartment 14 has a box-like configuration with an open-front side 20 which faces the interior of the sink, three side walls 21–23, and an open top 24.. A pair of stiffeners 26 (FIG. 1) on opposite sides of the compartment 14 assist in supporting the compartment. As best illustrated in FIGS. 2 and 3, the opposed side walls have, respectively, upper and lower aligned stops 28 and 29, respectively, extending outwardly into the compartment 14. The rear wall 22 at its upper portion has one stop 30 extending outwardly into the compartment 14. The drain 16 comprises of a brass, annular, tapered inlet 32 which is seated securely in a passageway 34 leading to a waste water treating system.

Figure 4:
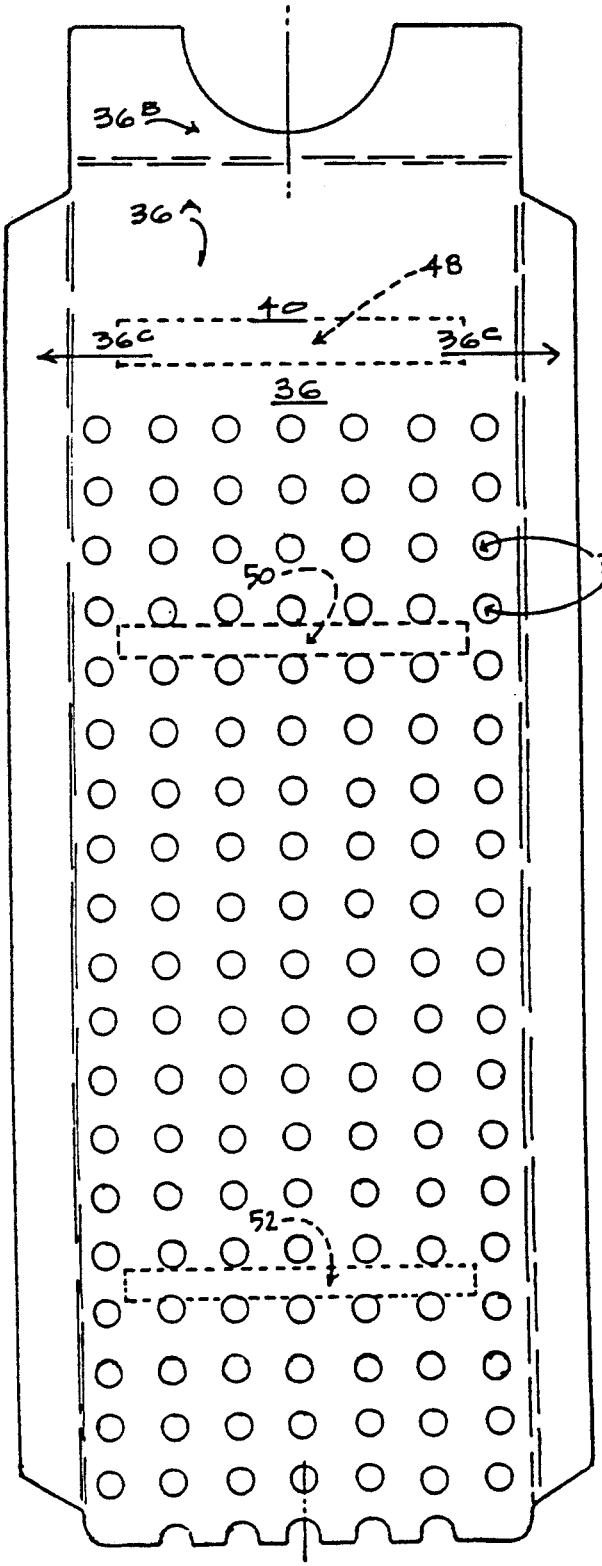
FIG. 4 is a plan view of the front face of the preform of the strainer element prior to folding edge portions of the preform to make the strainer element.
Figure 5:
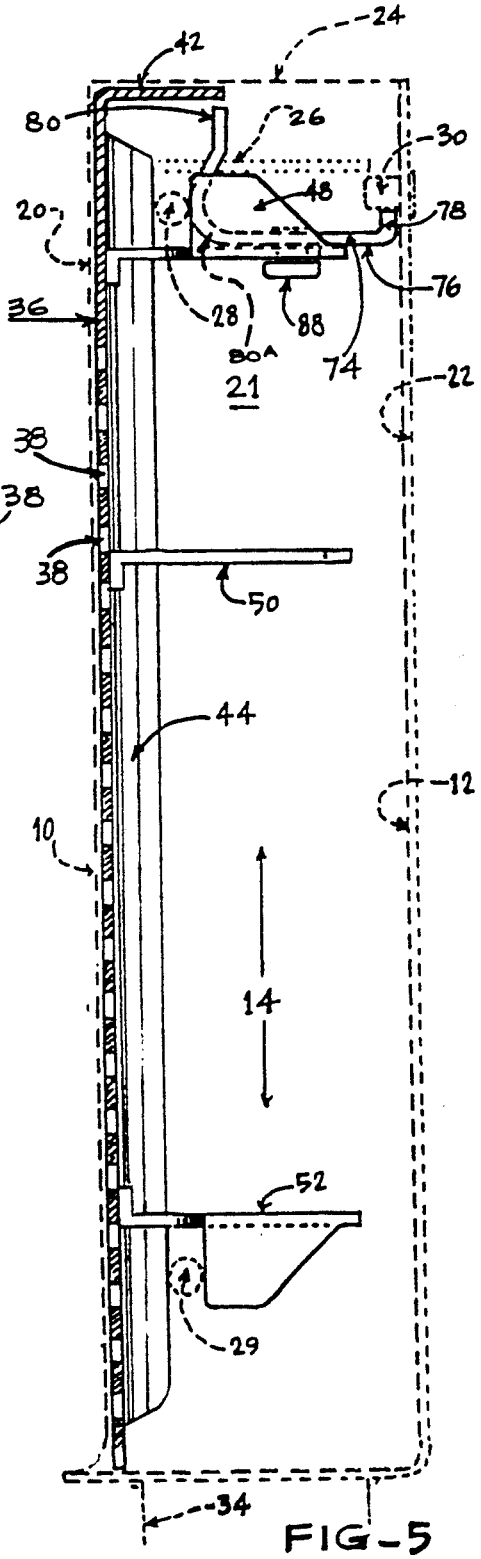
FIG. 5 is a cross-sectional view of the strainer element with guide members and a catch attached to it and positioned in the open front side of the compartment in the back piece shown in FIG. 1.
Figure 6:
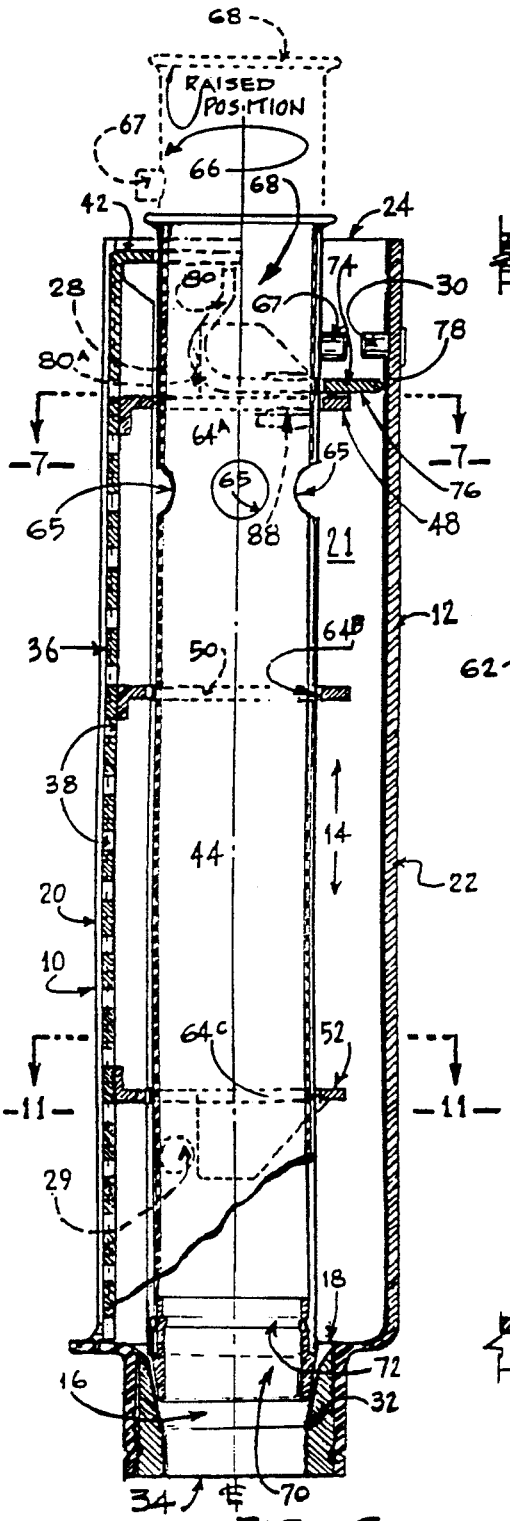
FIG. 6 is a cross-sectional view of the drain fixture of this invention similar to the view of FIG. 5, showing the standpipe in a lowered position to close off the drain of the fixture.
Figure 7:
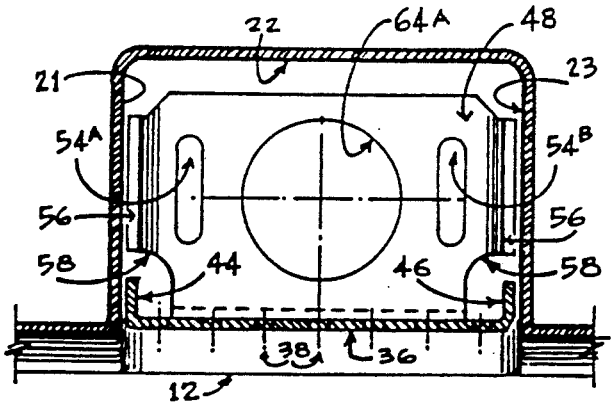
FIG. 7 is a cross-sectional view taken along line 7—7 of FIG. 6, which the standpipe removed.
Figure 8:
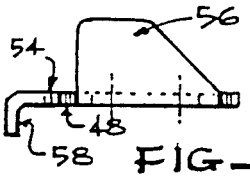
FIG. 8 is a side elevational view of the upper guide member of the drain fixture shown in FIGS. 5 and 6.
Figure 9:
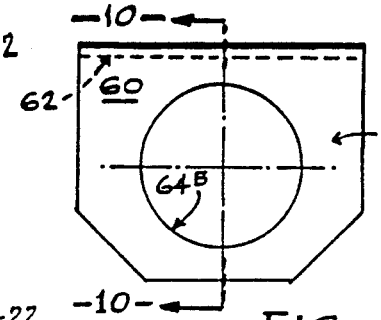
FIG. 9 is a plan view of the middle guide member of the drain fixture shown in FIGS. 5 and 6.
Figure 10:
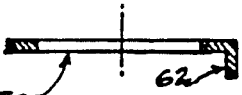
FIG. 10 is a cross-sectional view taken along line 10—10 of FIG. 9.
Figure 13:
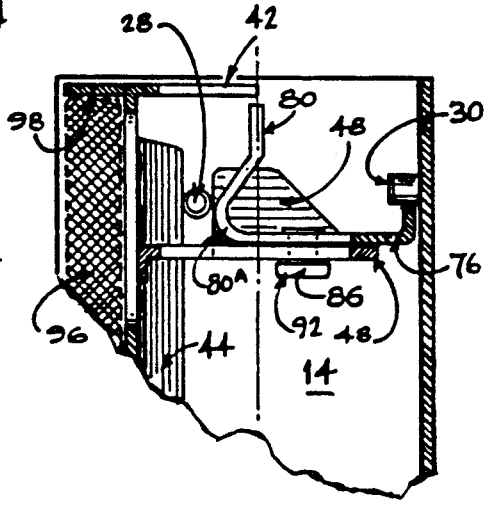
FIG. 13 is a fragmented, cross-sectional view of the upper portion of the drain fixture taken along line 13—13 of FIG. 12.
Figure 14:
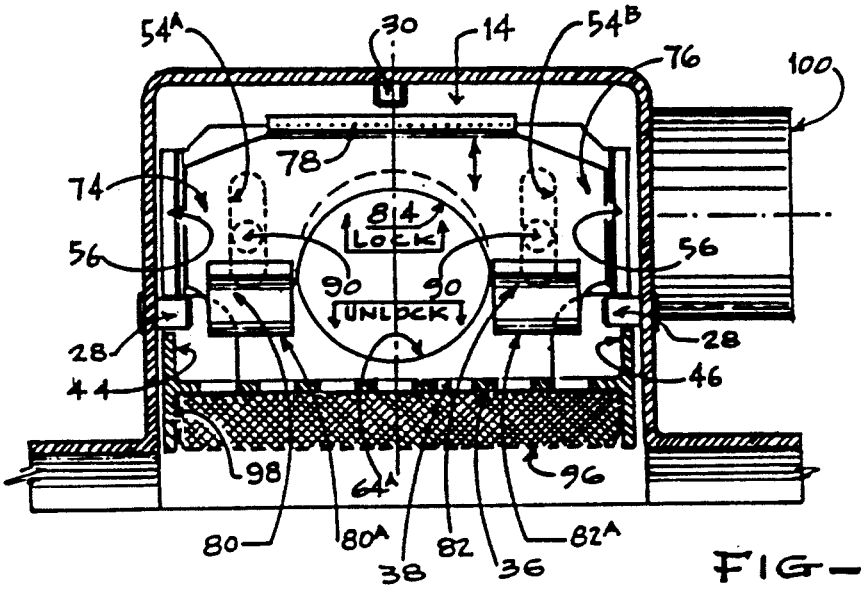
FIG. 14 is a cross-sectional view taken along line 14—14 of FIG. 12.
Figure 15:
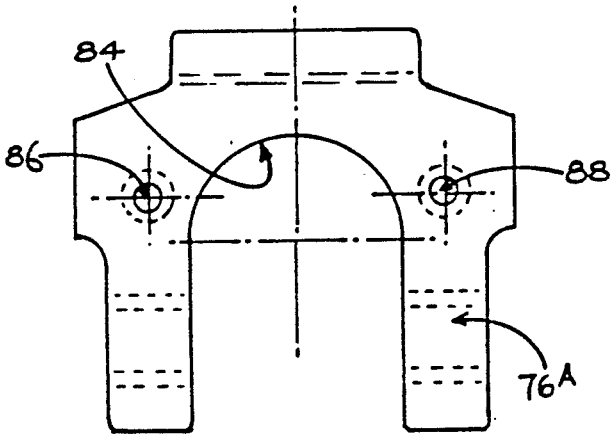
FIG. 15 is a plan view of a preform of a latch plate prior to folding its rear edge and arms.

As best shown in FIGS. 4, 5, and 6, a strainer 36 is seated in the open front side 20 of the compartment 14. This strainer 36 has a plurality of openings or perforations 38 in its face 40 (FIG. 4) which allow liquid to flow through the strainer, but prevent large, solid chunks from entering the compartment 14 when the strainer is in position as shown. The strainer 36 is made from a preform 36*a* (FIG. 4) which has its top 36*b* and sides 36*c* folded inward to create an upper ledge 42 (FIGS. 5, 6, 13, and 18) and two opposed flanges 44 and 46 (FIG. 14). Extending outwardly from the inside of the strainer 36 are three guide plates: upper guide plate 48, middle guide plate 50, and lower guide plate 52. The upper and lower guide plates 48 and 50 are essentially of the same configuration as shown in FIGS. 7 and 8. They each comprise a generally flat, horizontal plate 54 having laterally disposed slots 54*a* and 54*b* therein and two opposed wings 56 at its lateral edges and a lip 58 at its inner edge which is welded to the inside surface of the strainer 36. There are opposed cutaway sections 58 which, as will be explained in greater detail subsequently, allow the stops 28 and 29 to clear the guide plates 48 and 52 upon removal or insertion of the strainer 36 into position at the open front side 20 of the compartment 14. As illustrated in FIGS. 9 and 10, the middle guide 50 includes a generally flat plate 60 with a lip 62 which is welded to the inside surface of the strainer 36. All of the guide plates 48, 50 and 52 have a central generally circular opening 64*a*, 64*b*, and 64*c*, respectively, which are aligned with each other. The diameters of these openings 64*a*–64*c* are equal to each other and slightly greater in diameter than the diameter of a standpipe to allow the standpipe 66 to be inserted through these openings as depicted in FIGS. 6 and 18.

The standpipe 66 has opened top and bottom ends 68 and 70, respectively, with the bottom end including a brass tapered fitting 72 (FIG. 6) that mates with the drain inlet 32 when the standpipe is in the lower position as depicted in solid lines in FIG. 6. There are orifices 65 near the upper end of the standpipe 66 which allow water to flow into the standpipe and through the passageway 34 to prevent overflow from the sink. The position of the orifices 65 may be adjusted for the particular application. A stop 67 projects from the standpipe and, as will be explained in greater detail subsequently, is used to limit the vertical movement of the standpipe when it is locked in position. The standpipe 66 may be manually moved to a raised position as illustrated in dotted lines in FIG. 6 to allow liquid to flow through the perforations 38 in the strainer 36 and into the passageway 34.

Figure 17:
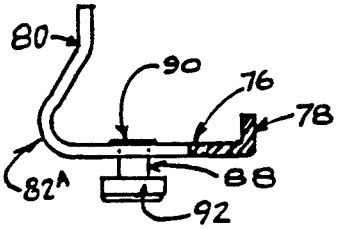
FIG. 17 is a side elevational view of the latch plate.
Figure 16:
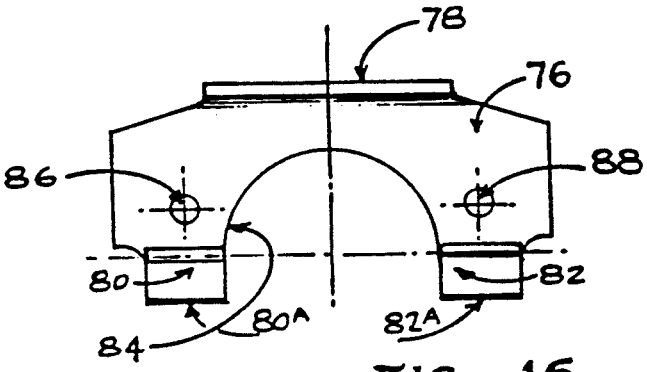
FIG. 16 is a plan view of the latch plate.
Figure 18:
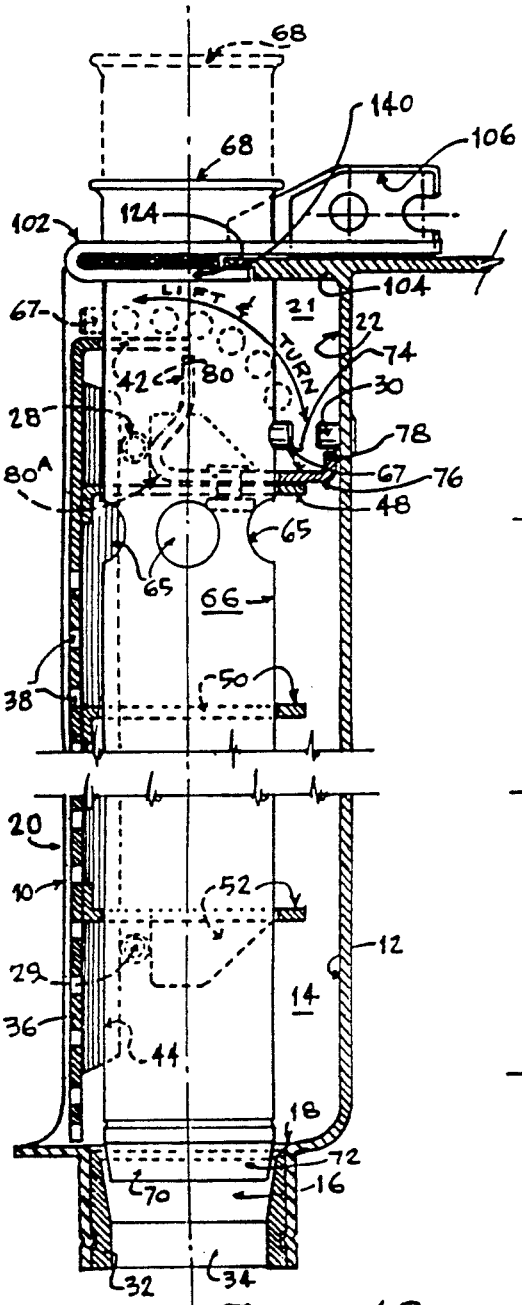
FIG. 18 is a cross-sectional elevational view of a second alternate embodiment of this invention, employing a lock to prevent the complete removal of the standpipe.
Figure 19:
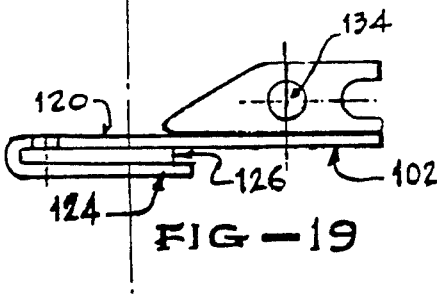
FIG. 19 is a side elevational view of the lock plate used in FIG. 18.
Figure 20:
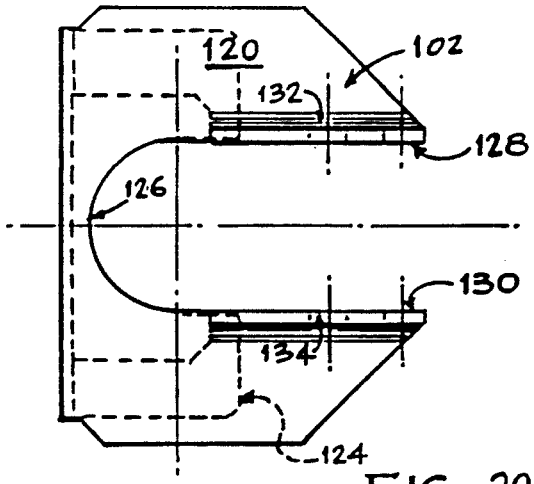
FIG. 20 is a plan view of the lock plate shown in FIG. 19.
Figure 21:
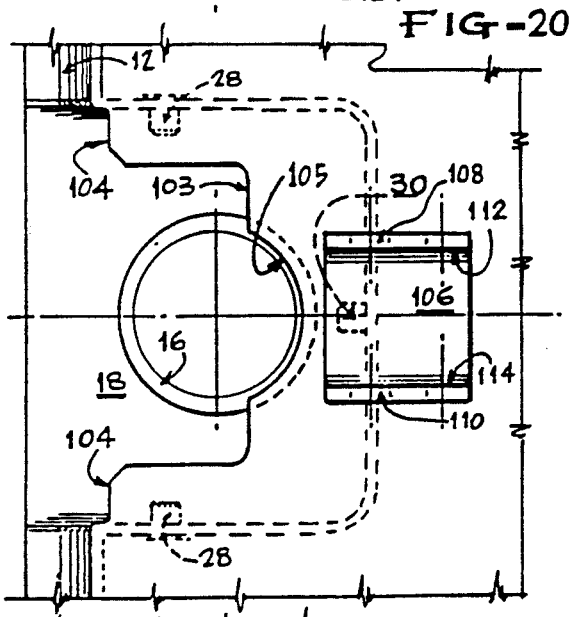
FIG. 21 is a plan view of a sink top having a locking flange welded to this sink top.
Figure 22:
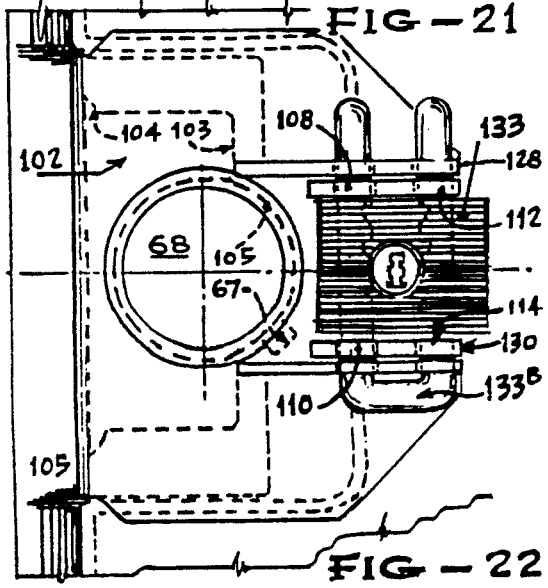
FIG. 22 is a plan view showing the drain fixture with a pad lock in position locked to the locking flange.

As shown in FIGS. 5, 6 and 14 through 18, a catch 74 is used to hold the strainer 36 in position, but allow the standpipe 66 to be raised and lowered, or removed if not locked as shown in FIGS. 18 and 22. This catch 74 includes a latch plate 76 made from a flat preform 76a shown in FIG. 15. The preform 76a is bent to form a raised lip 78 at the forward end with fingers 80 and 82 that each project upwardly from knuckles 80a and 82a, respectively. A central semi-circular like slot 84 is provided to allow the standpipe 66 to pass through the catch 74 when the catch is in the latched position (FIG. 14). A pair of pins 86 and 88 extend outwardly from the bottom the latch plate 76. As best shown in FIG. 17, each pin 86 and 88 have a shaft section 90 that terminates an enlarged head 92. The catch 74 is formed by assembly of the latch plate 76 and the upper guide plate 48 so that the enlarged heads 92 are on one side of the elongated slots 54a and 54b, with the shaft sections 90 being positioned in these slots to allow the latch plate to slide back and forth over the upper guide plate 48 between latched and unlatched positions as depicted in the FIG. 14. As shown in FIGS. 6 and 13, the tips of the fingers 80 and 82 are just beneath the ledge 42 of the strainer 36 and serve to prevent the stop 67 on the standpipe 66 from wedging beneath the ledge when it is rotated.

The strainer 36 and standpipe 66 are easily positioned and removed from the compartment 14. To accomplish this, the strainer 36 is first positioned with the upper and lower guide plates 48 and 52 sufficiently above the stops 28 and 29 so that, when the strainer is moved horizontally, the wings 56 of the lower guide plate will clear the lower stops 29 and the underside of the upper guide plate will clear the upper stops 28. The strainer 36 is moved horizontally to the right as shown in FIG. 6 until the edge of the flanges 44 and 46 engage the upper and lower stops 28 and 29. The cutaway sections 58 in the upper and lower guide plates 48 and 52 allow the stops to clear. Next, the strainer 36 is allowed to drop vertically. The stops 28 and 29 are now received between the flanges and the wings 56 so the strainer 36 is held in position as shown in FIG. 6. The latch plate 76 is moved to the latched position as shown in FIG. 14 so that it does not obstruct the aligned openings 64a–64c in the guide plates 48, 50 , and 52, respectively. The standpipe 66 may now be dropped through these openings 64a–64c and positioned as shown in FIG. 6. The standpipe 66 can be raised slightly so that its bottom end 70 clears the drain 16 to allow liquid to flow into the passageway 34. If the sink fills up to the upper level as indicated by line A (FIG. 6), the holes 65 in the standpipe 66 allow the liquid to flow into the standpipe and out the drain 16. With the latch plate 76 in the latched position, the raised lip 78 engages the underside of the stop 30 in the rear wall 22 of the compartment 14. This prevents the strainer 36 from being removed, because it cannot be lifted upwardly. By removing the standpipe 66 completely and then pushing the latch towards the strainer 36 into the unlatched position depicted in FIG. 14, the lip 78 can clear the stop 30, allowing the strainer to be lifted upwardly and then horizontally for removal.

Figure 12:
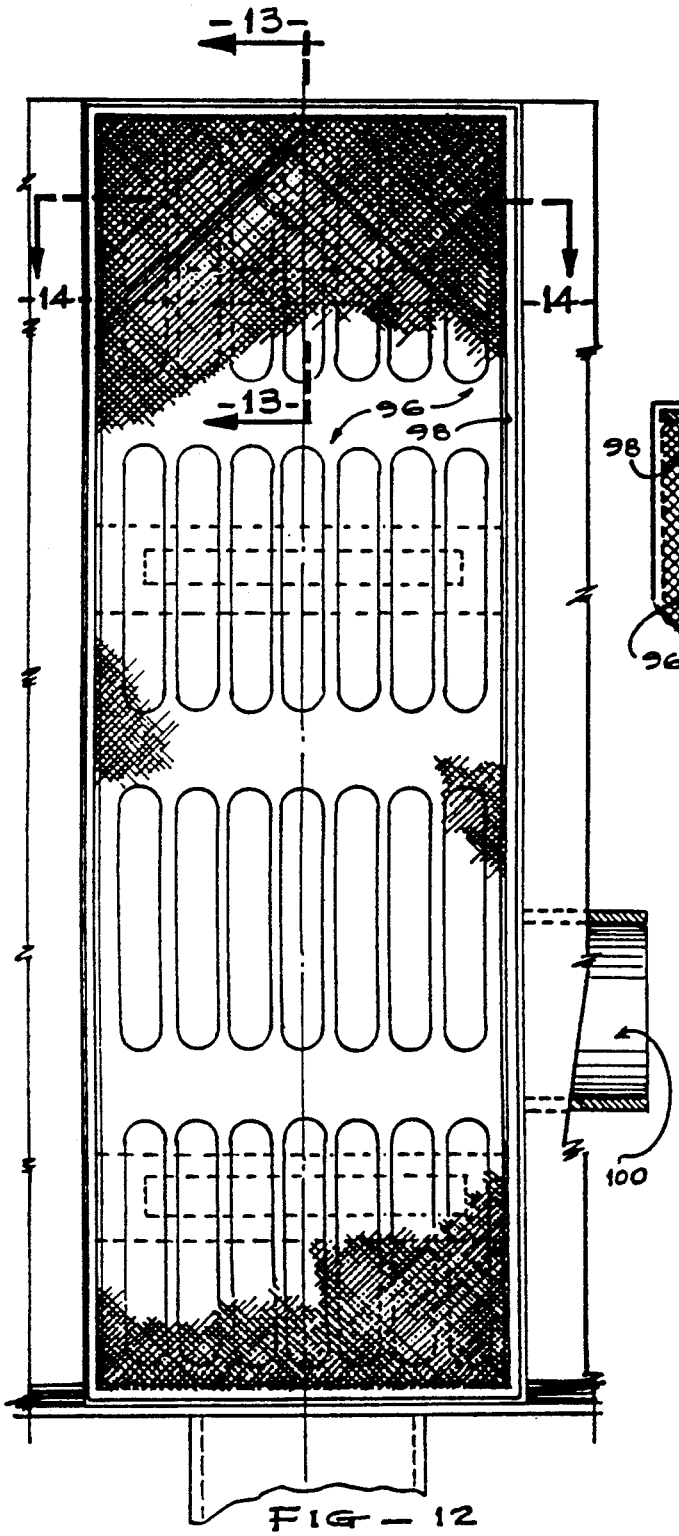
FIG. 12 is a front elevational view of the first alternate embodiment of this invention.

As shown in FIGS. 12 through 14, an alternate embodiment employs a filter 96 which is forced-fitted into a recess section 98 that provides a space between its opposed walls 98a and 98b in the strainer 36. This filter 96 will purify any hydrocarbon in the liquid and the purified hydrocarbons will flow around the standpipe 66 to an outlet 100 which is in communication to a basin (not shown). That is, after passing through the filter 96, the purified hydrocarbon and liquid, with the standpipe 66 in the drain 16, flow into the outlet 100. This allows the hydrocarbons to be reused and eliminates them from the liquid flowing into the waste treating facility, thereby making it easier to purify the waste water. The filter 96 may be easily removed and replaced with a new one as required.

As illustrated in FIG. 18 through 22, a locking plate 102, a conventional pad lock 103, and a cover are employed to lock the standpipe 66 in position so it cannot be removed, but allows it to be raised and lowered to open the drain 16. The cover 104 is welded to the top of the sink, partially covering the open top 24 of the compartment 14. It includes a forward edge 103 having a semi-circular indentation 105 which is positioned to abut the perimeter of the standpipe 66 and a generally U-shaped member 106. The U-shaped member 106 has a pair of aligned holes 108 and 110 in upwardly protecting arms 112 and 114.

The locking plate 102 has a base 120 with a underside flange 124 having a forward semi-circular recess 126 in it and a pair of upwardly extending walls 128 and 130 having therein aligned holes 132 and 134, respectively. The locking plate is slipped over the open top 24 of the compartment 14 and pushed towards the U-shaped member until the flange 124 engages a step 140 (FIG. 18) on the underside of the cover 104. The edge of the recess 126 and the indentation 105 of the cover 104 engage the perimeter of the standpipe. The holes 132 and 134 in the locking plate 102 are now aligned with the holes 108 and 110 in the U-shaped member. The padlock 103 is then placed into position with one of its legs 103a passing through the aligned holes 132, 108, 110, and 134. Thus, when the standpipe 66 is lifted and rotated, the stop 67 will engage the underside of the locking plate 102 and prevent the standpipe from being completely removed from the compartment 14. The stop 67, upon rotation, may be positioned to overlie the ledge 42 so that the standpipe 66 can be maintained in a raised position. By rotation of the standpipe 66 and lowering it, the stop 67 may then be positioned to clear the ledge 42 to allow the standpipe t be returned to the lower position as shown in FIG. 18.

The plumbing fixture 10 essentially eliminates clogging of the drain 16 because the liquid flows initially in a generally horizontal direction through the strainer 36. The strainer 36, with the aid of gravity, preventing solid material from entering the compartment 14. Then the liquid, free of solids, flows in a generally vertical direction downward though the drain 16 into the passageway 34.

All the major components of the drain fixture 10 are preferably made of stainless steel.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A plumbing fixture comprising a side piece having a predetermined height and including an elongated compartment extending lengthwise along at least a portion of the height of the side piece, said compartment including a bottom having a passageway therein which is adapted to be placed in communication with a drainage system and an open side which allows liquid from a sink to flow into the compartment, a removable strainer element having a perforated face and positioned at the open side of the compartment to prevent solid material from flowing from the sink into the compartment, a standpipe member having an open bottom end and being movable between a raised position for drainage and a lowered position where said open bottom end is inserted into the passageway, catch means manually movable between a latched position to hold the strainer element in position and an unlatched position which allows said strainer element to be removed from the open side of the compartment, and locking means which prevents the standpipe from being manually withdrawn from the fixture but allows the standpipe to be moved between the raised and lowered positions.

2. The plumbing fixture of claim 1 where the standpipe member has an upper end with an orifice thereat which allows liquid to flow through the orifice and the standpipe into the passageway to allow drainage when the liquid level in the sink is approaching an overflow level.

3. The plumbing fixture of claim 1 where the standpipe member may be manually withdrawn from the fixture when the catch means is in the latched position.

4. The plumbing fixture of claim 1 including filter means overlying the face of the strainer element adapted to purify liquid hydrocarbons which may be present in liquid which is flowing through the fixture.

5. The plumbing fixture of claim 4 including means in communication with the filter means for directing purified hydrocarbons from the sink.

6. The plumbing fixture of claim 1 where the compartment includes alignment elements and said strainer element includes means which in conjunction with the alignment elements guide the strainer element into position at the open side of the compartment and hold said strainer element in said position.

7. A plumbing fixture comprising a side piece having a predetermined height and including an elongated compartment extending lengthwise along at least a portion of the height of the side piece, said compartment including a bottom having a passageway therein which is adapted to be placed in communication with a drainage system and an open side which allows liquid from a sick to flow into the compartment, a removable strainer element having a perforated face and positioned at the open side of the compartment to prevent solid material from flowing from the sink into the compartment, a standpipe member having an open bottom end and being movable between a raised position for drainage and a lowered position where said open bottom end is inserted into the passageway, and catch means manually movable between a latched position to hold the strainer element in position and an unlatched position which allows said strainer element to be removed from the open side of the compartment, said catch means comprising a stop extending outwardly from a wall of the compartment, a guide member connected to the strainer element and extending into the compartment which has an opening therein that allows the standpipe member to pass there through when the catch means is in the latch positioned, and latch means which is manually movable between the latched position where the latch means engages said stop and the unlatched positioned where the latch means disengages from the stop.

8. A plumbing fixture comprising a side piece having a predetermined height and including an elongated compartment extending lengthwise along at least a portion of the height of the side piece, said compartment including a bottom having a passageway therein which is adapted to be placed in communication with a drainage system and an open side which allows liquid from a sick to flow into the compartment, a removable strainer element having a perforated face and positioned at the open side of the compartment to prevent solid material from flowing from the sink into the compartment, a standpipe member having an open bottom end and being movable between a raised position for drainage and a lowered position where said open bottom end is inserted into the passageway, and catch means manually movable between a latched position to hold the strainer element in position and an unlatched position which allows said strainer element to be removed from the open side of the compartment, said strainer element having a ledge which extends into the compartment when the strainer element is at the open side of the compartment, and the standpipe member has a stop element near its upper end that is adapted to rest on said ledge by lifting and rotating the standpipe so that said stop element is overlying sand ledge.

9. The plumbing fixture of claim 8 including means which prevent the stop element on said standpipe member from being positioned beneath said ledge.

* * * * *